US006547102B2

(12) United States Patent
Stoneberg

(10) Patent No.: US 6,547,102 B2
(45) Date of Patent: Apr. 15, 2003

(54) SWIVEL TOP CLOSURE

(75) Inventor: Thomas C. Stoneberg, Buffalo Grove, IL (US)

(73) Assignee: Courtesy Corporation, Buffalo Grove, IL (US)

( * ) Notice: Subject to any disclaimer, the term of this patent is extended or adjusted under 35 U.S.C. 154(b) by 0 days.

(21) Appl. No.: 09/832,701

(22) Filed: Apr. 11, 2001

(65) Prior Publication Data

US 2002/0148863 A1 Oct. 17, 2002

(51) Int. Cl.[7] ..... B65D 47/08
(52) U.S. Cl. ..... 222/143; 222/557
(58) Field of Search ..... 222/143, 548, 222/557

(56) References Cited

U.S. PATENT DOCUMENTS

| | | | | | |
|---|---|---|---|---|---|
| 163,394 | A | * | 5/1875 | Norton | 222/557 |
| 458,264 | A | | 8/1891 | Alliger | |
| 538,092 | A | * | 4/1895 | Wanner, Jr. | 222/557 |
| 888,733 | A | * | 5/1908 | Perkins | 222/557 |
| 1,013,394 | A | | 1/1912 | Hull | |
| 1,477,452 | A | * | 12/1923 | Saunders | 222/557 |
| 1,618,926 | A | * | 2/1927 | Harrison | 222/557 |
| 1,734,564 | A | * | 11/1929 | Crary | 222/557 |
| 2,011,999 | A | * | 8/1935 | Entriken | 222/557 |
| 2,039,145 | A | * | 4/1936 | Burns | 222/557 |
| 2,313,784 | A | * | 3/1943 | Then | 222/557 |
| 2,817,451 | A | * | 12/1957 | Giles | 222/548 |
| 3,140,020 | A | * | 7/1964 | Spier | 222/557 |
| 5,383,582 | A | * | 1/1995 | Baxter et al. | 222/548 |
| 5,632,394 | A | | 5/1997 | Mecca et al. | |
| 6,332,551 | B1 | * | 12/2001 | Copeland | 220/262 |

* cited by examiner

*Primary Examiner*—Kenneth Bomberg
(74) *Attorney, Agent, or Firm*—Silverman, Cass & Singer, Ltd.

(57) ABSTRACT

A swivel top closure including a base and a top affixed to the base, the top being movable with respect to the base along the horizontal plane in swivel-like motion between a closed position in which the top fully covers an opening in the base to an open position in which the top uncovers the opening.

17 Claims, 6 Drawing Sheets

FIG. 5
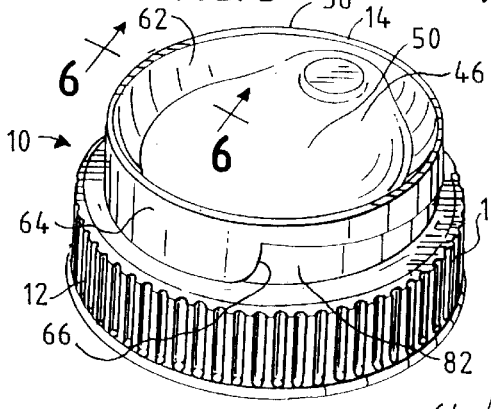
FIG. 7
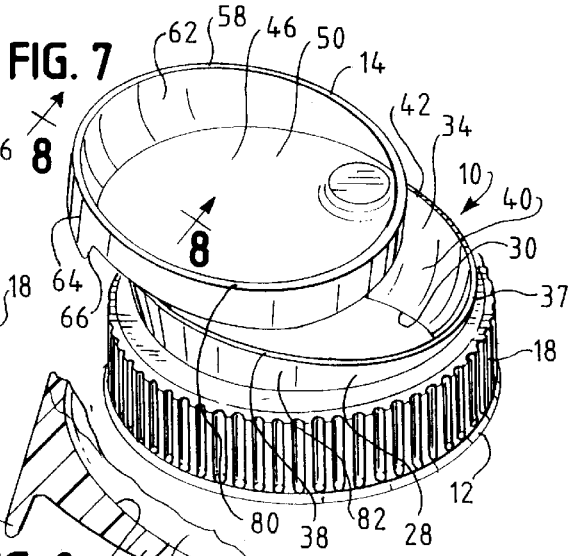
FIG. 6
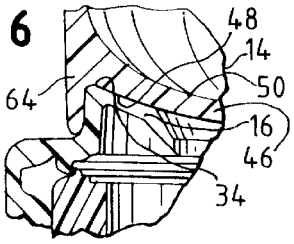
FIG. 8
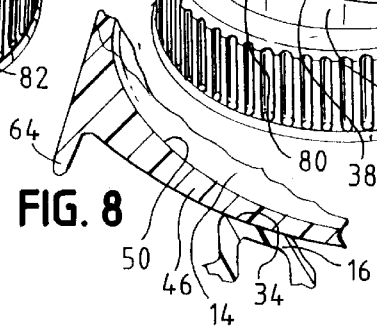
FIG. 9
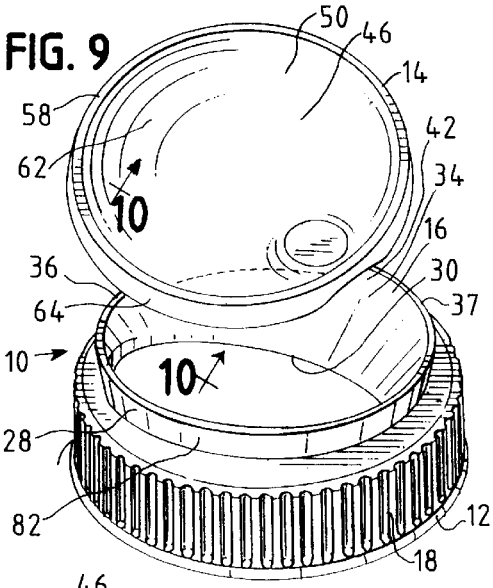
FIG. 11
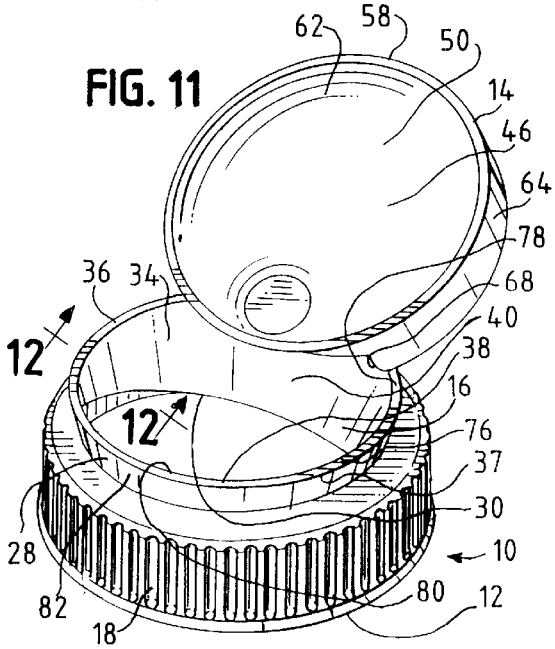
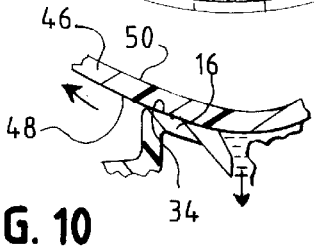
FIG. 10
FIG. 12
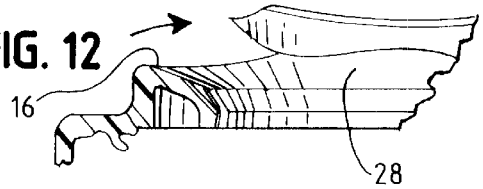

6/6

SWIVEL TOP CLOSURE

BACKGROUND OF THE INVENTION

1. Field of the Invention

This invention relates generally to dispensing closures for containers, and more particularly, to such closures which include a base potion affixed to the container and a separate top portion which is cooperatively engageable upon the base portion and adapted to be swiveled thereabout between a fully closed and a fully opened condition of said closure to permit dispensing of product from the container.

2. Description of the Prior Art

Dispensing closures for containers are known and commonly include a base portion adapted to be positioned upon the mouth of a container and a separately formed cap or top portion which is cooperatively engageable upon said base portion to complete the closure.

Hinged dispensing closures for containers also are known and commonly include a cap hingedly connected to a base and capable of being pivoted with respect to the base between a closed and an open dispensing position. In the closed position, the cap covers a dispensing opening formed in the base, and in the open position, the cap is moved away from the opening to permit product to be dispensed from the container.

Also known in the art are hinged dispensing closures which include features to maintain the cap in its open position away from the base without the need for application of an extraneous restraining force, and also to maintain the cap in closed position over the base when the cap is pivoted to such closed position.

It is desirable to provide a dispensing closure which includes a base and top that is engageable upon the base and movable between a closed position on the base and a fully open position, which closure utilizes a swivel engagement construction between the top and base rather than a hinge connecting construction therebetween. Preferably, such swivel top closure is formed from separately molded top and base portions which are assembled together to provide the desired closure. Also preferably, the swivel top portion of the closure is movable between a first closed position on the base to a second fully opened position where the top is maintained in said opened position without the need for application thereagainst of an extraneous restraining force.

SUMMARY OF THE INVENTION

The invention is characterized by a two piece closure including a base portion and a separately formed top portion. The base portion includes a generally horizontally disposed platform or deck and a circumferential skirt depending from and surrounding the platform. The skirt is adapted to be secured to the mouth of a container by engagement of the skirt about said mouth. A passageway is formed in the platform to permit the contents of the container to pass therethrough and be dispensed through the closure. The top portion includes a depending post formed on the underside thereof which is engageable within a hole formed in the platform. Once so engaged upon the base, the top is movable along the horizontal plane in swivel-like motion with respect to the base between a closed position in which the top fully covers the passageway in the base to an open position in which the top uncovers the passageway, thereby permitting the contents of the container to be dispensed through the passageway formed in the base. The top is maintained in its closed position and its open position without application of any extraneous restraining force applied thereto.

Various objects and advantages of the invention will become apparent in accordance with the above and ensuing disclosure in which the preferred embodiments are described in detail in the specification and illustrated in accompanying drawings. It is contemplated that minor variations may occur to persons skilled in the art without departing from the scope or sacrificing any of the advantages of the invention.

BRIEF DESCRIPTION OF THE DRAWINGS

FIG. 5 is a perspective view of the closure similar to that of FIG. 1;

FIG. 6 is an enlarged sectional view taken along the line 6—6 of FIG. 5, in the direction indicated generally;

FIG. 7 is a perspective view of the closure in which the top is shown in a partially opened position with respect to the base;

FIG. 8 is an enlarged sectional view taken along the line 8—8 of FIG. 7, in the direction indicated generally;

FIG. 9 is a perspective view of the closure in which the top is shown in a nearly fully opened position with respect to the base;

FIG. 10 is an enlarged sectional view taken long the line 10—10 of FIG. 9, in the direction indicated generally;

FIG. 11 is a perspective view of the closure similar to that of FIG. 2;

FIG. 12 is an enlarged sectional view taken along the line 12—12 of FIG. 11, in the direction indicated generally;

DESCRIPTION OF THE PREFERRED EMBODIMENTS

Figure 1:
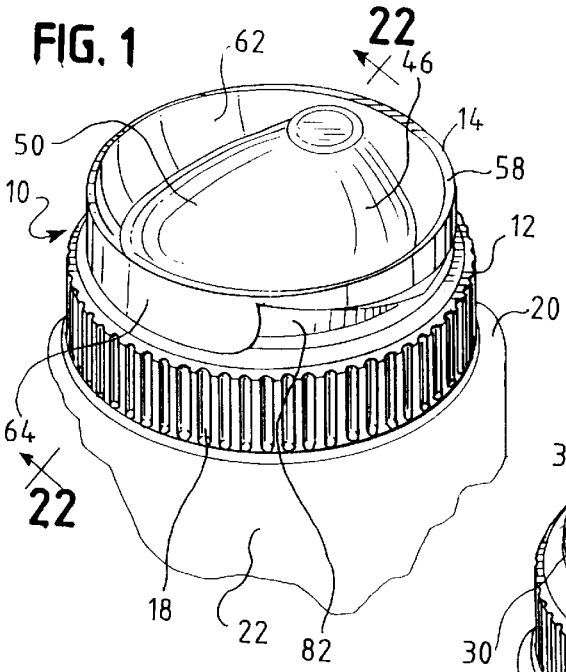
FIG. 1 is a perspective view of the swivel top closure of the invention, in which the top is shown in its closed position with respect to the base.
Figure 2:
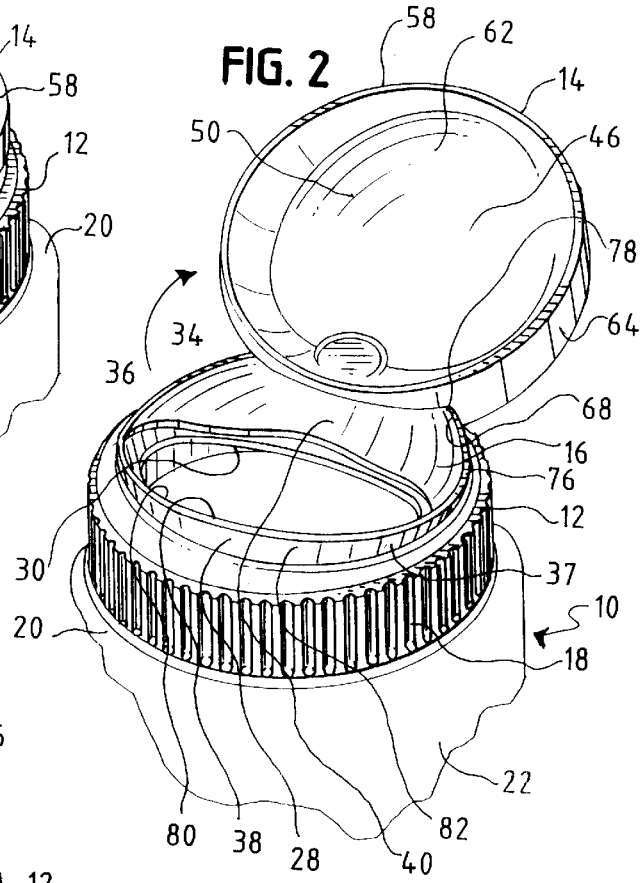
FIG. 2 is a perspective view of the closure in which the top is shown in its fully opened position with respect to the base.
Figure 3:
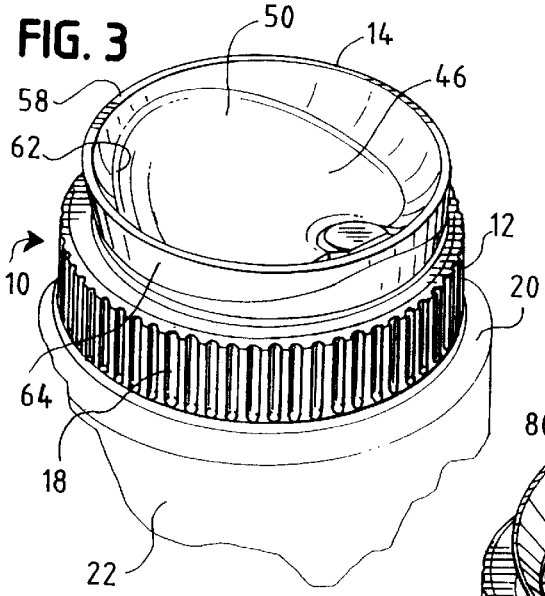
FIG. 3 is a view similar to that of FIG. 1 in which the closure is rotated to a position different than that shown in FIG. 1.
Figure 4:
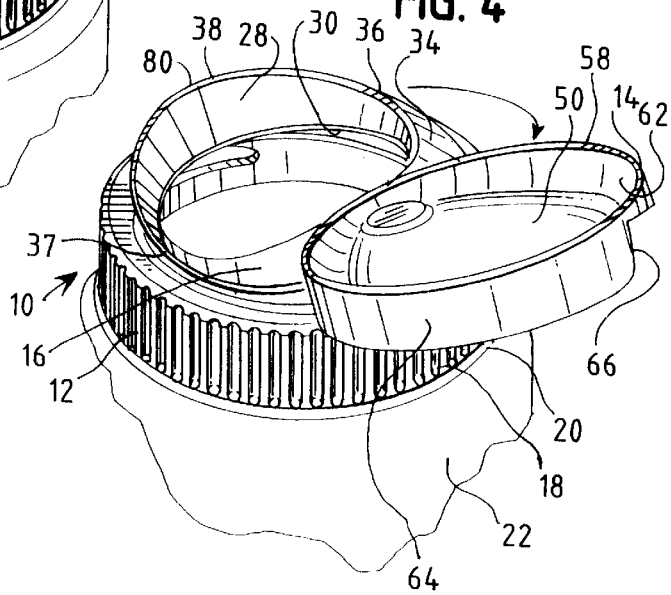
FIG. 4 is a view similar to that of FIG. 2 in which the closure is rotated to a position different than that shown in FIG. 2.

Referring to the drawings, the swivel top closure 10 of the invention preferably is formed of molded plastic material and includes a base 12 and a separately formed top 14. The base 12 includes a generally horizontally disposed platform or deck 16 and a circumferential skirt 18 depending from and surrounding the platform 16.

The base 12 is adapted for attachment to the mouth 20 of a container 22 by engagement of screw threads 24 formed on the inner-facing surface 26 of skirt 18 which mate with like threads (not shown) formed on the mouth 20 of container 22 in conventional manner.

Platform 16 is disposed over mouth 20 when the closure 10 is installed upon the container 22. A lip 28 is formed on platform 16 upstanding therefrom and is positioned adjacent to passageway 30 which passes through the platform between the bottom surface 32 disposed adjacent to mouth 20 and the top surface 34 of said platform. Lip 28 rises from low points 36, 37 which merge with platform 16 on opposite sides of passageway 30 to a high point 38 disposed proximate to the mid-length of the lip 28. Lip 28 functions as a pouring lip about passageway 30 to facilitate pouring of the contents of container 22 through mouth 20 and direct same therefrom when dispensing of such contents is desired.

The top surface 34 of platform 16 is of generally angled and contoured configuration and rises from a low point 40 disposed proximate to passageway 30 to a high point 42 spaced away from passageway 30 and located generally opposite to high point 38 of lip 28. A hole 44 is formed in platform 16 proximate to high point 42 for a purpose to be described below.

Top 14 functions as a lid for base 12 to cover passageway 30 when the closure is in closed orientation and prevent dispensing of the contents of container 22 through mouth 20. Top 14 includes a generally horizontally disposed wall 46 having a bottom surface 48 adapted for mating engagement with top surface 34 of platform 16 and a top surface 50 on the side of wall 46 opposite to bottom surface 48. Wall 46 is generally contoured and dish-shaped in configuration such that the bottom contoured surface 48 contacts and mates against top surface 34 of platform 16 when top 14 is positioned upon base 12. Top contoured surface 50 of wall 46 forms a depression or concave dish-like external configuration of the top 14.

Figure 22:
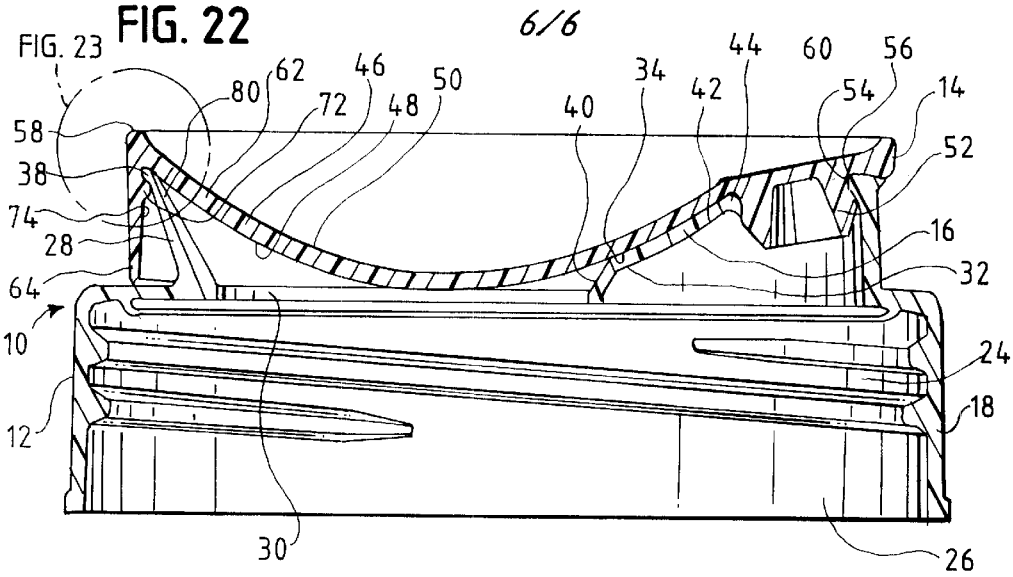
FIG. 22 is a sectional view taken along the line 22—22 of FIG. 1, in the direction indicated generally.

A depending post 52 is formed on bottom surface 48 and is matingly engageable within hole 44 in platform 16 and retained therein by engagement of slot 54 of post 52 within peripheral surface 56 of hole 44. The engagement of post 52 within hole 44 is such as to permit top 14 to swivel about the horizontal plane with respect to base 12 to which the top is secured when post 52 is engaged within hole 44. The swivel axis of engagement 60 (see FIG. 22) of post 52 within hole 44 is generally tilted with respect to normal. As such, the bottom surface 48 of top 14 is moved away from top surface 34 of platform 16, and thereby out of engagement with passageway 30, when the top is moved from closed position to open position with respect to the base.

A stacking rim 58 projects above the top surface 50 of wall 46 and extends with consistent perimeter height about the entire circumferential edge 62 thereof. A depending skirt 64 is formed partially about the circumferential edge 62 of wall 46 and projects downwardly below bottom surface 48 between a first stop edge 66 and a second stop edge 68 spaced approximately 180° from first stop edge 66.

When top 14 is positioned upon base 12 with post 52 engaged within hole 44, bottom surface 48 of wall 46 engages against top surface 34 of platform 16 in close contact such that passageway 30 is closed and sealed to prevent the contents of container 22 from being dispensed through mouth 20. The closed position of top 14 against base 12 is maintained without the application of any extraneous force because of the contact between post 52 within hole 44. In order to enhance such closed position and ensure its maintenance, an inwardly projecting nub 72 is formed on the inner surface 74 of skirt 64 proximate to first stop edge 66. Nub 72 engages against lip 28 near high point 38 thereof to securely retain top 14 in contact with base 12 when the top is in its closed position.

When top 14 is swiveled about base 12 to open the closure, the cooperating contoured undersurface of the top rides against the top surface 34 and continues until second stop edge 68 of skirt 64 engages against surface 76 of platform 16 at a location 78 in the general vicinity of hole 44. During the opening operation of top 14, the condition of passageway 30 changes from fully closed (FIG. 5) to partially or variably opened (FIG. 7) and finally to fully opened (FIG. 11). Also during such opening operation the top edge 80 of lip 28 between low points 36 and 37 and along high point 38 wipes against bottom contoured surface 48 of top 14 to move material which may be adhered thereto off of such surface. Thus, during such opening operation, any product from container 22 which may be adhered to surface 48 will be wiped from such surface to fall back through passageway 30 into the container.

The fully opened or variably opened positions of top 14 with respect to base 12 are maintained without the application of any extraneous force because of the engagement of the post 52 within hole 44. In such positions the contents of container 22 may be dispensed through passageway 30 without the top falling over passageway 30 because the closure operation takes place only by swivelling the top about the base and not pivoting the top as is the case in prior art hinged constructions.

Figure 23:
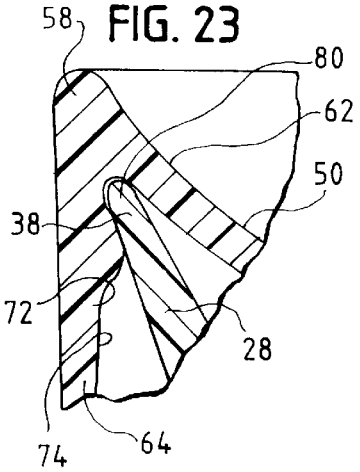
FIG. 23 is an enlarged view of the section portion 33 shown in FIG. 22.

After the top 14 has been moved to its fully opened position with respect to base 12, the procedure can be reversed to close the closure and top 14 is swivelled about post 52 upon swivel axis 60 in the opposite direction until first stop edge 66 of skirt 64 engages against surface 82 of lip 28 at a location in the general vicinity of high point 38. During such closing operation, any undesirable debris which may be adhered to undersurface 48 will be wiped and cleaned therefrom by top edge 80 of lip 28 to fall away from passageway 30 before undersurface 48 is positioned thereagainst. When moved to its fully closed position (see FIG. 23) the bottom contoured surface 48 of top 14 is engaged against top mating contoured surface 34 of platform 30 and passageway 30 to seal same.

Figure 13:
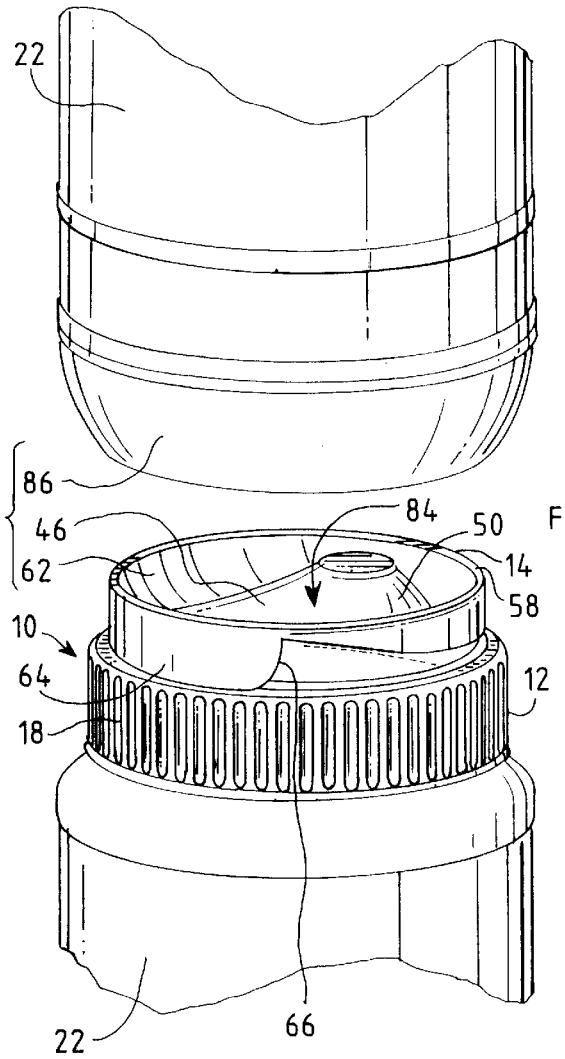
FIG. 13 is a perspective view of the closure similar to that of FIG. 1, showing the manner in which a container (shown in fragment) may be stacked upon another container having the closure of the invention positioned thereon.
Figure 14:
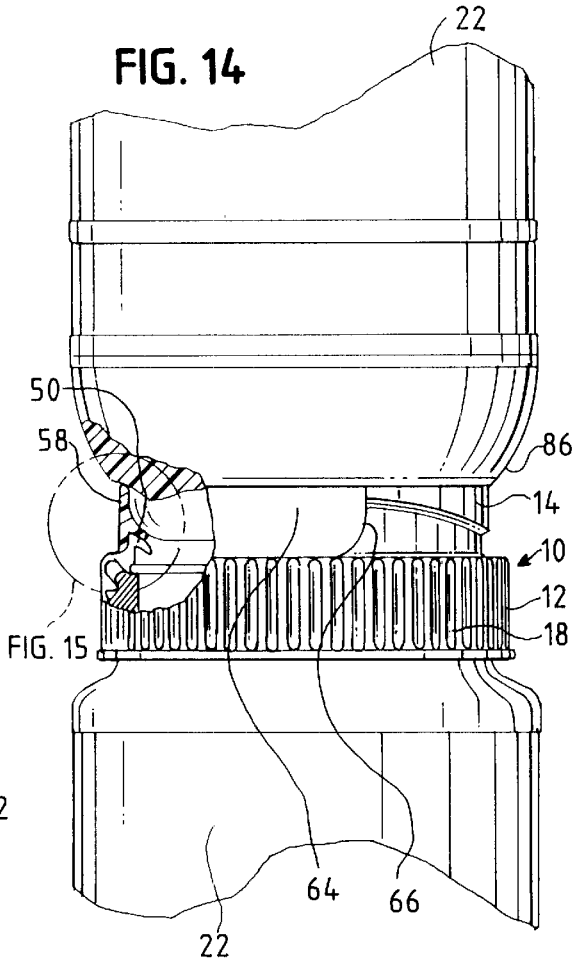
FIG. 14 is a perspective view similar to that of FIG. 13, with a portion thereof shown in section.
Figure 15:
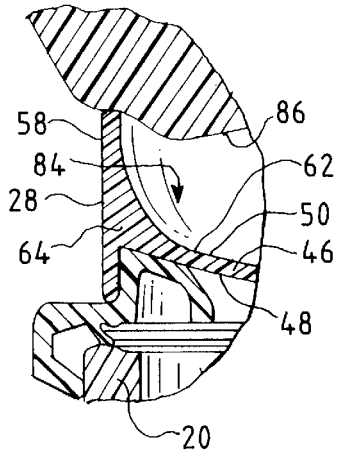
FIG. 15 is an enlarged view of the section portion 15 shown in FIG. 14.
Figure 16:
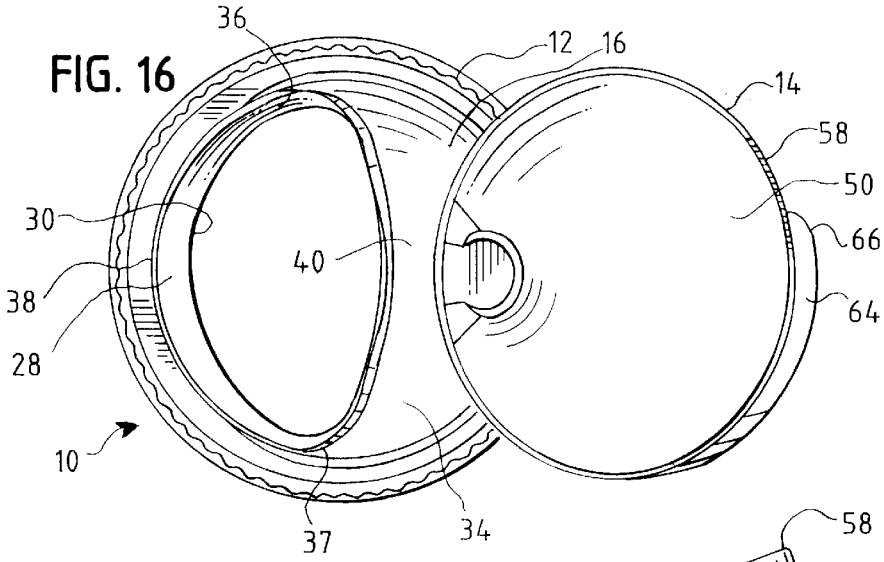
FIG. 16 is a top plan view of the closure in which the top is shown in its fully opened position as shown in FIG. 2.
Figure 17:
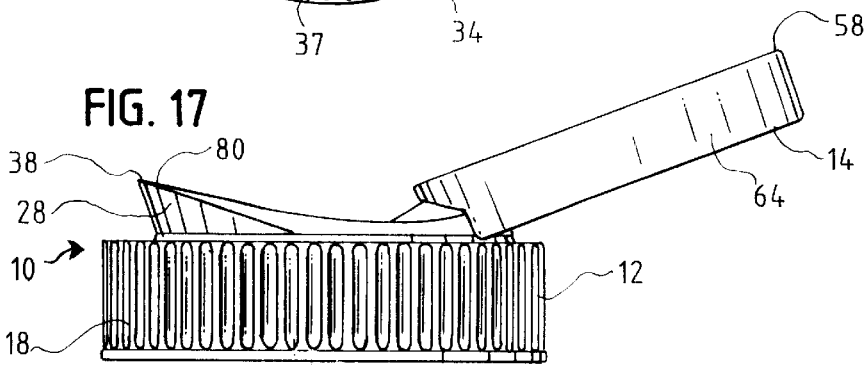
FIG. 17 is a side elevational view of the closure as shown in FIGS. 2 and 16.
Figure 18:
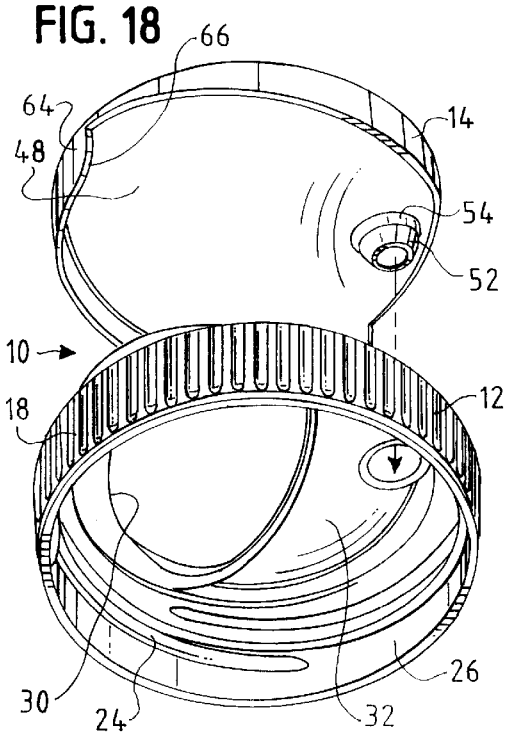
FIG. 18 is a bottom perspective view of the top and base portions of the closure exploded one with respect to the other.
Figure 19:
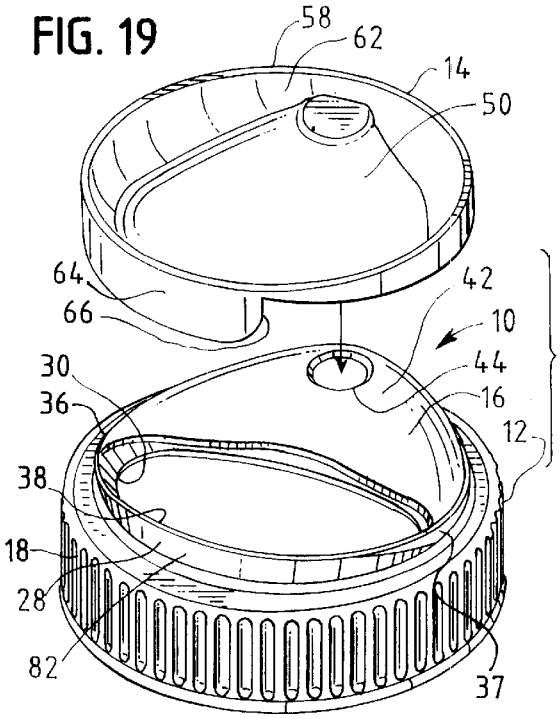
FIG. 19 is a top perspective view of the top and base portions of the closure exploded one with respect to the other.
Figure 20:
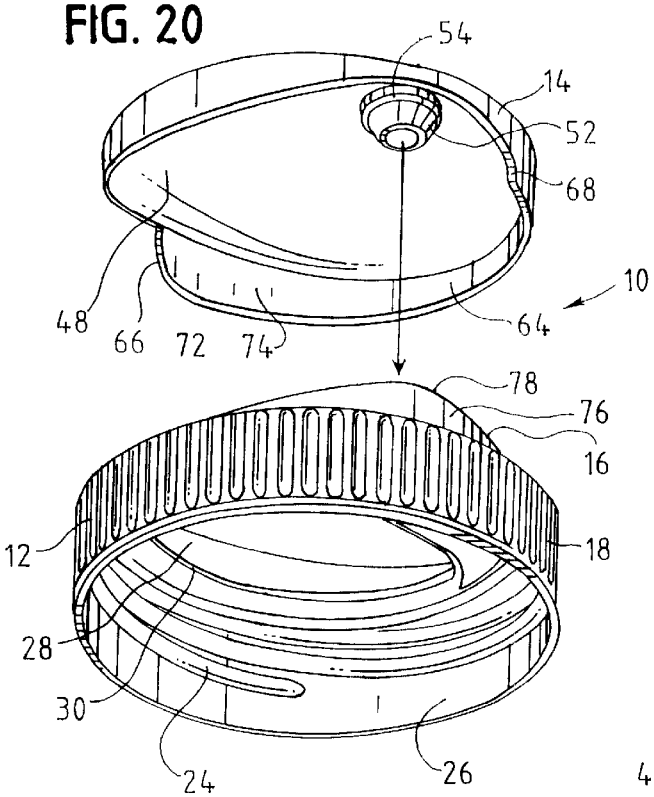
FIG. 20 is a perspective view similar to that of FIG. 18 in which the top and base portions of the closure are rotated to a position different than that shown in FIG. 18.
Figure 21:
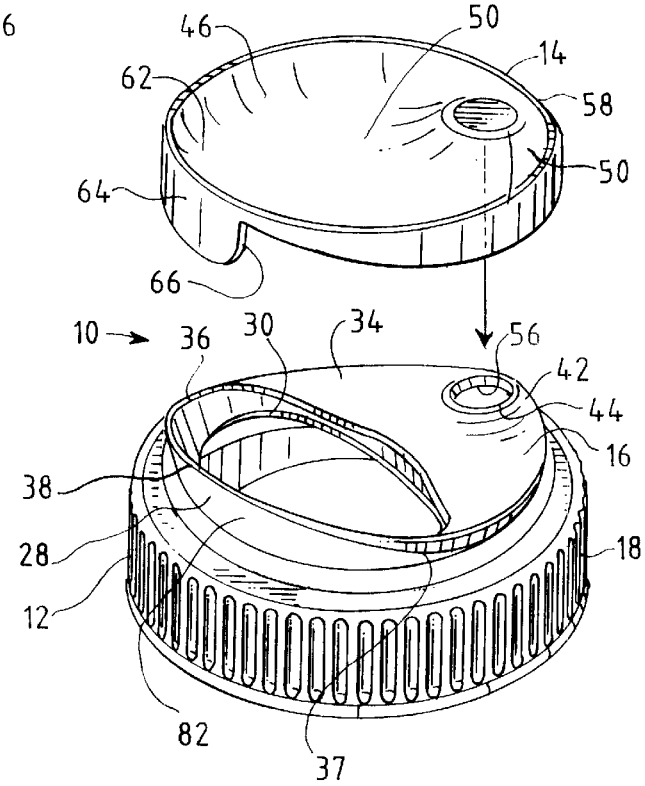
FIG. 21 is a perspective view similar to that of FIG. 19 in which the top and base portions of the closure are rotated to a position different than that shown in FIG. 19.

Referring to FIGS. 13–15, stacking rim 58 is provided to facilitate stacking of a second container 22' upon container 22 having closure 10 applied thereto. The stacking rim 58, having a consistent perimeter height about the circumferential edge 62, in conjunction with the concave dish-like top surface 50 forms a receiving or cradling area 84 upon which a container 22' with mating bottom surface 86 may be positioned in nesting-like fashion. In this manner, multiple containers may conveniently be stacked one upon another, as desired.

Figure 24:
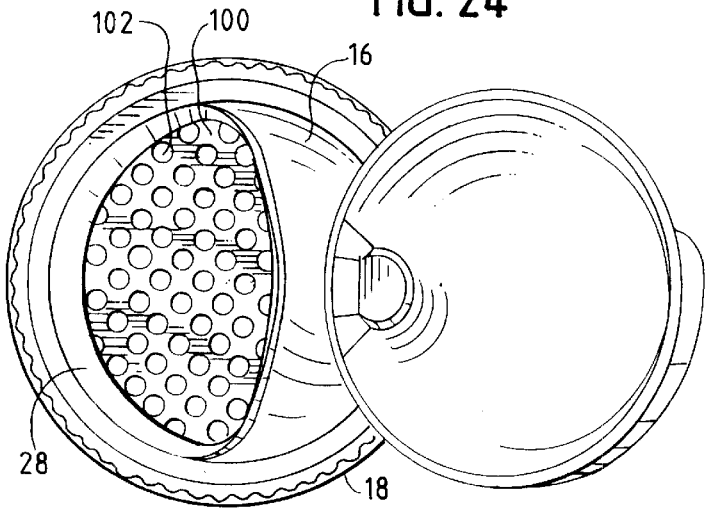
FIG. 24 is a top plan view of an alternate embodiment of the closure of the invention in which the top is shown in its fully opened position with respect to the base.
Figure 25:
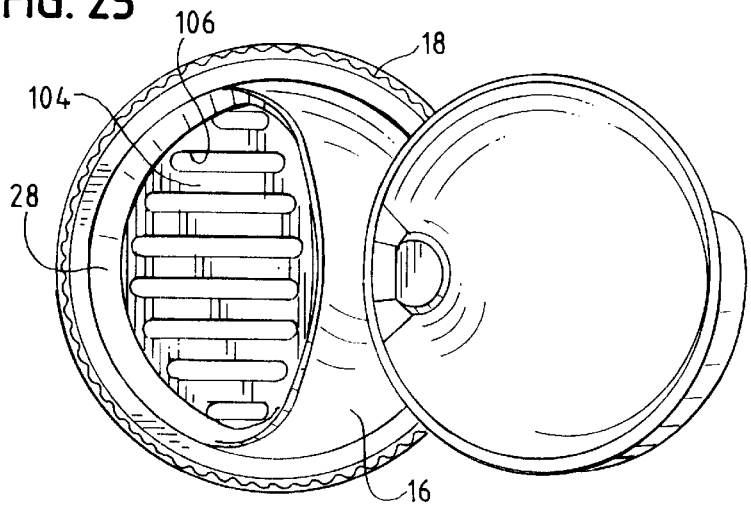
FIG. 25 is a top plan view of a further alternate embodiment of the closure of the invention in which the top is shown in its fully opened position with respect to the base.

In the preferred embodiment shown in FIGS. 1–23, the passageway 30 is illustrated as being a single opening. It is to be understood that such passageway is only one configuration contemplated to function as a product dispensing opening in the closure of the invention. For example, the passageway 30 may be replaced by a dispensing opening 100 comprising multiple small holes 102 (FIG. 24), or a dispensing opening 104 having multiple slots 106 (FIG. 25). In all other respects, the closures illustrated in FIGS. 24 and 25 are the same as that illustrated in FIGS. 1–23.

Other configurations and variations in the structure, arrangement and size of the various parts may occur to those skilled in the art without department from the spirit or circumventing the scope of the invention as set forth in the appended claims.

What is claimed is:

1. A closure for a container having a mouth, said closure comprising, a base including a horizontally disposed platform and a skirt surrounding said platform and adapted to be positioned adjacent to said mouth, a passageway in said platform disposed adjacent to said mouth to permit the contents of said container to pass therethrough, said platform having a hole positioned therein proximate to said passageway, a top having a generally horizontally disposed wall, a post formed on said wall and depending therefrom, said post adapted to be engaged within the hole, said top being movable along the horizontal plane about an axis of engagement between the post and the hole in swivel motion with respect to the base between a closed position in which the top fully covers the passageway in the base to an open position in which the top uncovers the passageway, the axis of engagement between the post and the hole being generally tilted with respect to normal, said top being maintained in either its open or closed position without application of any extraneous restraining force applied thereto.

2. A closure as claimed in claim 1 in which the passageway is an unrestricted opening.

3. A closure as claimed in claim 1 including an elongate lip formed on said platform upstanding therefrom, said lip being positioned adjacent to said passageway and rising from low points which merge on opposite sides of the passageway to a high point disposed proximate to the mid-length of the lip.

4. A closure as claimed in claim 3 in which the platform has a top surface, said top surface being of generally angled and contoured configuration which rises from a low point disposed proximate to said passageway to a high point spaced away from said passageway and located generally opposite to the high point of said lip.

5. A closure as claimed in claim 4 in which the wall of said top has a bottom surface adapted for mating engagement with the top surface of said platform, said wall being of generally contoured dish-shaped configuration such that the bottom countered surface of the wall contacts and mates against the top surface of the platform when the top is moved to its closed position.

6. A closure as claimed in claim 5 in which the wall of said top has a top contoured surface which forms a concave dish-like depression.

7. A closure as claimed in claim 6 in which the wall of said top includes a stacking rim projecting above the top surface thereof, said stacking rim having a consistent perimeter height above the top.

8. A closure as claimed in claim 6 in which said wall of said top includes a depending skirt formed partially around the peripheral edge of said wall and projecting downwardly below the bottom surface thereof between a first stop edge and a second stop edge spaced approximately 180° from said first stop edge.

9. A closure as claimed in claim 8 in which said skirt has an inner surface, a nub found on said inner surface proximate to said first stop edge, said nub engaging against said lip near the high point thereof when said top is in its closed position.

10. A closure as claimed in claim 8 in which said second stop edge engages against the platform when the top is moved to its open position.

11. A closure as claimed in claim 5 in which the lip has a top edge which wipes against the bottom contoured surface of the closure top when the top is moved with respect to said base.

12. A closure as claimed in claim 1 in which the passageway includes a plurality of openings.

13. In combination with a container having a mouth, a closure for said container, said combination comprising, a base including a horizontally disposed platform and a skirt surrounding said platform and adapted to be positioned adjacent to said mouth, a passageway in said platform disposed adjacent to said mouth to permit the contents of said container to pass therethrough, said platform having a hole positioned therein proximate to said passageway, a top having a generally horizontally disposed wall, a post formed on said wall and depending therefrom, said post adapted to be engaged within the hole, said top being movable along the horizontal plane about an axis of engagement between the post and the hole in swivel motion with respect to the base between a closed position in which the top fully covers the passageway in the base to an open position in which the top uncovers the passageway, the axis of engagement between the post and the hole being generally titled with respect to normal, said top being maintained in either its open or closed position without application of any extraneous restraining force applied thereto.

14. The combination as claimed in claim 13 including an elongate lip formed on said platform upstanding therefrom, said lip being positioned adjacent to said passageway and rising from low points which merge on opposite sides of the passageway to a high point disposed proximate to the mid-length of the lip.

15. The combination as claimed in claim 14 in which the platform has a top surface, said top surface being of generally angled and contoured configuration which rises from a low point disposed proximate to said passageway to a high point spaced away from said passageway and located generally opposite to the high point of said lip.

16. The combination as claimed in claim 15 in which the wall of said top has a bottom surface adapted for mating engagement with the top surface of said platform, said wall being of generally contoured dish-shaped configuration such that the bottom countered surface of the wall contacts and mates against the top surface of the platform when the top is moved to its closed position.

17. The combination as claimed in claim 16 in which the wall of said top has a top contoured surface which forms a concave dish-like depression, a stacking rim projecting above said top contoured surface, said stacking rim having a consistent perimeter height above the top, said container including a bottom surface adapted to matingly engage the top contoured surface of a closure installed on another container.

* * * * *